United States Patent [19]

Autorino et al.

[11] Patent Number: 4,871,168

[45] Date of Patent: Oct. 3, 1989

[54] BALL BAT

[76] Inventors: Joseph A. Autorino; Jeffrey P. Crouch, both of 170 Brittany Farms Rd., New Britain, Conn. 06053

[21] Appl. No.: 260,120

[22] Filed: Oct. 20, 1988

[51] Int. Cl.[4] ..... A63B 69/40

[52] U.S. Cl. ..... 273/26 B; 273/72 R; 273/186 A; 73/443; 73/515; 116/272; 272/124; 272/DIG. 5

[58] Field of Search ..... 273/67 R, 67 A, 72 R, 273/72 A, 73 R, 26 A, 26 B, 183 D, 186 A, 193 R, 193 A; 73/379, 515, 492, 493, 500, 535, 551, 512; 116/321, 324, 266, 272, 281; 272/128, DIG. 5, DIG. 9, 124

[56] References Cited

U.S. PATENT DOCUMENTS

| | | | |
|---|---|---|---|
| 1,779,685 | 8/1929 | Washburne | 73/575 |
| 2,780,098 | 2/1957 | Maroth | 273/186 A |
| 3,097,534 | 7/1963 | Pasieka | 73/492 |
| 3,578,801 | 5/1971 | Piazza | 273/72 R |
| 4,267,793 | 5/1981 | Lone et al. | 273/72 R |
| 4,377,125 | 3/1983 | Westfall | 273/186 A |
| 4,759,219 | 7/1988 | Cobb et al. | 273/26 R |

*Primary Examiner*—Edward M. Coven
*Assistant Examiner*—Mark S. Graham
*Attorney, Agent, or Firm*—McCormick, Paulding & Huber

[57] ABSTRACT

A hollow plastic ball bat has an internally mounted swing metering device that provides a visual indication of swing velocity. The bat is defined by inner and outer members that are coupled to one another to define a recess that receives a transparent annular barrel. A bore in this barrel has a weighted piston that moves in the bore, as a result of its inertia, During a swinging or other movement of the bat itself.

5 Claims, 2 Drawing Sheets

BALL BAT

This invention relates generally to ball bats of the type adapted for use with trick balls such as the popular Whiffleball, or other plastic game balls of light weight construction.

More specifically, the primary purpose of the present invention is to provide a plastic ball bat having an indicator device to provide the user with a quantitative measure of the centrifugal force and/or bat velocity achieved during a swing of the bat.

Prior art devices of this type are known, and U.S. Pat. No. 4,267,793 issued to Lane et al, May 19, 1981 shows a conventional baseball bat with a projecting plunger that is connected to an internal plug provided in a cylindrical cavity. The extent to which the plunger projects from the end of the bat is a measure of the swing velocity or centrifugal force exerted during the batter's swing.

This prior art patent suggests the necessity for providing a projecting device adjacent the end of the bat. The necessity for including a projecting plunger that protrudes beyond the end of the bat is obviated in the present invention and the device disclosed provides a less obtrusive construction than the prior art devices. The user has a visual indication of his swing force or velocity from an internally provided piston visible through a window defined for this purpose in the unique bat configuration.

SUMMARY OF THE INVENTION

In accordance with the present invention an elongated ball bat is defined by two members, the first member defining a handle end of the bat and having an enlarged outer end portion opposite that handle end. Joined to the first member is a second member that defines an outer end of the bat. This second member has an inner end portion corresponding in size and shape to that of the first member's outer end portion and the means for coupling these inner and outer end portions also defines a cylindrical elongated cavity that contains a fluid such as air. The cavity or bore is closed at both ends by the first and second members. A weighted piston is slidably received in this cylindrical cavity and the piston defines a bleed hole for passing the fluid therethrough. Means is provided on the piston for impeding movement in one direction in the cavity and said means preferably comprises a cup-shaped diaphragm provided at one end of the weighted piston. The means coupling the first and second bat numbers preferably comprises a transparent annular shape cylinder that defines the cylindrical cavity or bore, and a label is wrapped around this transparent cylinder to define a window through which the user can gain an indication of piston position within the transparent cylinder to tell him how hard he has swung the bat. Both the first and second member, comprising a bat handle and a bat outer portion respectively are fabricated from plastic with a hollow interior. Each member is coupled to the other by integrally defined coengaging locking surfaces, such as male and female threads, in order to hold these members together and to secure the transparent cylindrical barrel therebetween.

DETAILED DESCRIPTION

Figure 1:
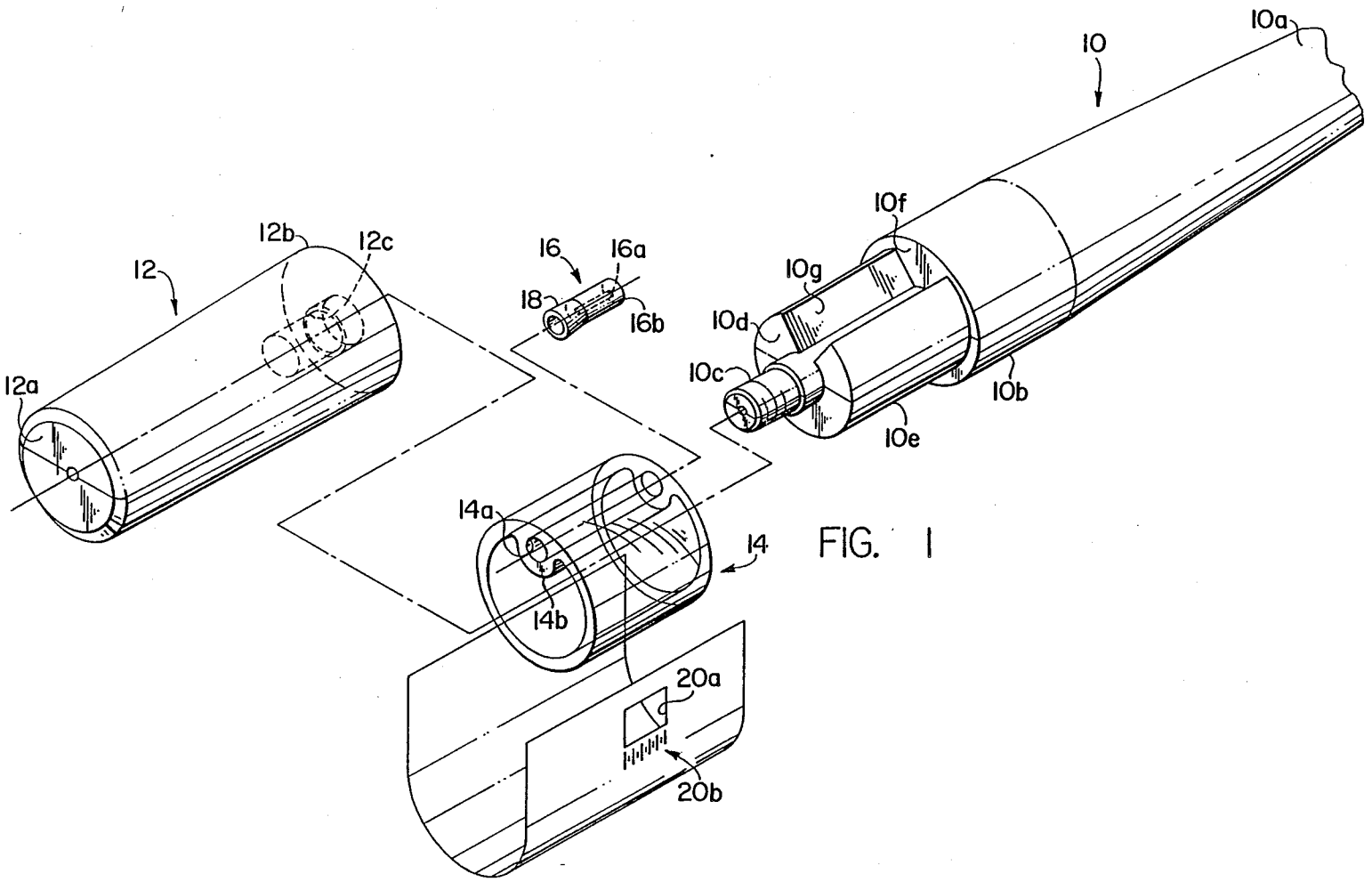
FIG. 1 is a perspective view showing the various components of the present invention in exploded relationship prior to their assembly.
Figure 2:
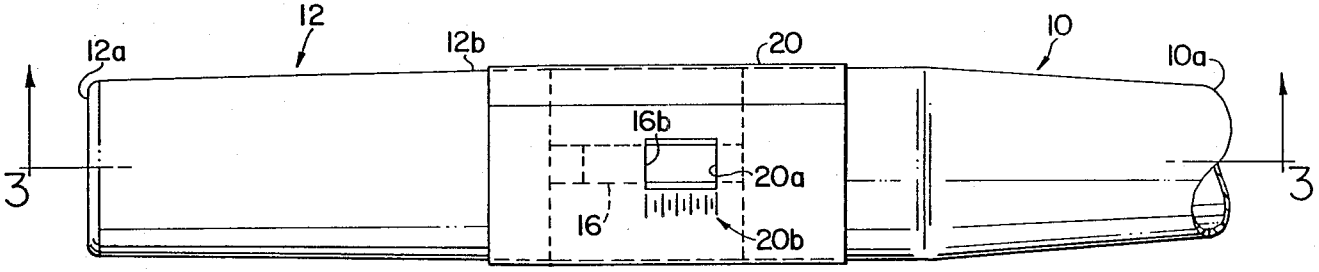
FIG. 2 is a view of the components illustrated in FIG. 1 in assembled condition.
Figure 3:
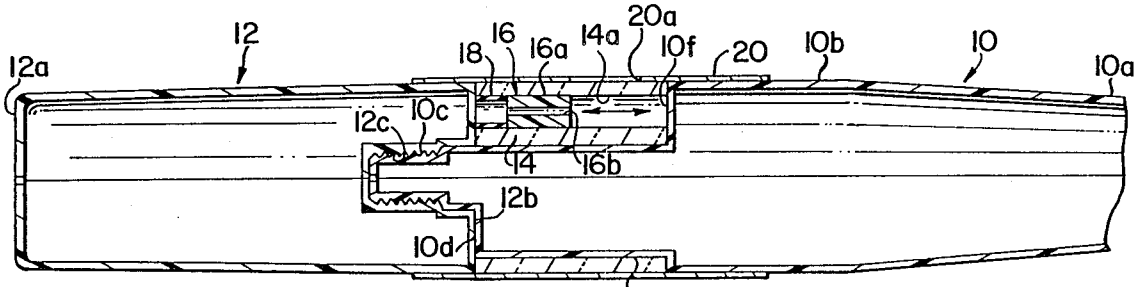
FIG. 3 is a sectional view taken generally on the line 3—3 of FIG. 2.

Turning now to the drawings in greater detail, FIG. 1 shows the various components of a hollow plastic bat which has been equipped with an indicating device in accordance with the present invention. In its presently preferred form such a ball bat comprises a first member 10 having a handle end (not shown) but conventionally defined at the right-hand end portion 10*a* of the first member 10. The first member 10 also includes an enlarged outer end portion 10*b* opposite the handle end 10*e* which outer end portion 10*b* has generally the same circular configuration as the inner end portion 12*b* of the second member 12 making up the overall configuration for the assembled bat. See FIGS. 2 and 3 for the assembled configuration of these components.

The second member 12 defines an outer end 12*a* of the assembled bat, and includes an integrally formed female threaded bore 12*c* that is adapted to threadably receive the male threaded portion 10*c* of the first member 10. It will be apparent that assembly of these components 10 and 12 will result in the inner end 12*b* of second member 12 being provided adjacent an annular surface 10*d* defined for this purpose on a portion 10*e* of the first member 10 that is adapted to be received inside an annular barrel 14 to be described.

The barrel 14 is fabricated from a transparent plastic material and has an axial length corresponding to the axial length of portion 10*e* of the first member 10 such that barrel 14 can be conveniently preassembled on this projecting portion 10*e* of first member 10 prior to coupling the second member thereto. The threaded portion 12*c* of second member 12 receives a threaded stud 10*c* defined for this purpose on the first member 10. The transparent cylindrical barrel is of annular shape as shown in FIG. 1, but also includes a portion 14*b* that defines a cylindrical bore or cavity 14*a*. The cavity or bore 14*a* is adapted to be closed at its inner end by the surface 10*f* of the first member and is adapted to be closed at its outer end by the surface at 12*b* referred to previously.

When the barrel is so assembled with the first and second members 10 and 12 air is trapped in the cylindrical cavity 14*a* so that placement of piston 16 in this cavity prior to such assembly will permit sliding movement of the pistons 16 in the cavity 14*a* as a result of swinging the bat and producing a centrifugal force on the piston 16, which is weighted for this purpose. This piston 16 includes a cupshaped diaphragm valve element 18 attached to one face so as to impede motion of the weighted piston 16 at least in the outward direction during a batter's swing. Furthermore, the piston 16 includes an internal bleed hole 16*a* which will permit air from one side of the piston to reach and to equalize with the air on the other side of the piston during swinging movement of the bat or during return movement of the piston. Return movement of the piston is achieved by tapping the handle end 10*a* on the ground with a force sufficient to cause the piston 16 to slide back to its initial position adjacent the surface 10*f* defining the inner of the cylinder 14*a*.

Finally, the ball bat of the present invention includes a a label or outer wrapping 20 that is adapted to encircle the transparent cylinder 14 and to be so placed that a window 20*a* defined in the label 20 will appear opposite the cylindrical bore or cavity 14*a* and afford the user a visual indication of piston position within that cavity. Graduations may be imprinted on the label 20, as shown generally at 20*b* in order to quantify the pistons position. This label is preferably so placed and so wrapped around the bat component that the inner end 16*b* of the piston 16 can be viewed through the window 20*a* and compared with these graduations 20*b* to provide a measure of the centrifugal force exerted by the user or swinger of the bat and/or an indication of the velocity of his swing.

While any convenient means may be provided for coupling the first and second bat members 10 and 12 respectively, the preferred form is the coengaging locking surfaces defined by the male and the female threaded end portions as referred to previously. Furthermore, the hollow cylindrical barrel 14 is designed to accept the portion 10*e* of the first member 10 in a manner that affords sufficient strength to the bat so that the bat can actually be used, at least with hollow plastic balls of the type used in the Whiffleball game, without damaging this swing meter device. A V-shaped recess 10*g* in the first member 10 provides a convenient means for locating and receiving the portion 14*b* of the hollow transparent barrel 14 that defines the bore 14*a*.

We claim:

1. An elongated ball bat comprising a first member defining a handle end of the bat and having an enlarged outer end portion opposite said handle end, a second member defining an outer end of the bat, said second member having an inner end portion corresponding in size and shape to said first member outer end portion, means coupling said inner and outer end portions, said coupling means defining an elongated cavity of constant cross section, said cavity containing a fluid and said cavity closed at one end by said first member and closed at its opposite end by said second member, a weighted piston slidably received in said cavity, said piston defining an opening for passing said fluid therethrough as a result of sliding movement of said piston in said cavity, means on said piston for impeding movement thereof from said one cavity end toward said opposite cavity end, said coupling means defining a transparent window adjacent said elongated cavity to permit observation of said piston position.

2. The ball bat of claim 1 wherein said coupling means further includes a generally annular barrel, said cavity defined in said barrel, and said first and second members defining an intermediate bat portion provided at least in part within said annular barrel, said intermediate bat portion including coengaging locking surfaces defined in part by first and second members for holding said members and said barrel in assembled relationship.

3. The ball bat of claim 2 wherein said barrel is molded from a transparent plastic to permit observation of said piston position in said cavity.

4. The ball bat of claim 3 wherein coengaging locking surfaces comprise male and female threaded portions of said members.

5. The ball bat of claim 4 wherein said first and second members are molded from plastic and are hollow to provide a light weight ball bat suitable for striking a hollow plastic ball.

* * * * *